US010415335B2

(12) United States Patent
Mhaskar et al.

(10) Patent No.: US 10,415,335 B2
(45) Date of Patent: Sep. 17, 2019

(54) INSERTS HAVING GEOMETRICALLY SEPARATE MATERIALS FOR SLIPS ON DOWNHOLE TOOL

(71) Applicant: Weatherford Technology Holdings, LLC, Houston, TX (US)

(72) Inventors: Nauman H. Mhaskar, Cypress, TX (US); James A. Rochen, Waller, TX (US); Jonathan A. Young, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 194 days.

(21) Appl. No.: 14/739,962

(22) Filed: Jun. 15, 2015

(65) Prior Publication Data

US 2015/0368994 A1 Dec. 24, 2015

Related U.S. Application Data

(60) Provisional application No. 62/013,835, filed on Jun. 18, 2014.

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01)

(58) Field of Classification Search
CPC ..... E21B 23/01; E21B 33/129; E21B 10/56
See application file for complete search history.

(56) References Cited

U.S. PATENT DOCUMENTS 2,888,247 A * 5/1959 Haglund ..... B22F 7/06 175/379
4,823,919 A 4/1989 Hayatdavoudi
5,984,007 A 11/1999 Yuan et al.
6,976,534 B2 12/2005 Sutton et al.
7,407,012 B2 * 8/2008 Keshavan ..... E21B 10/16 166/374

(Continued)

FOREIGN PATENT DOCUMENTS

CA 2842373 A1 * 8/2014 ..... E21B 33/129

OTHER PUBLICATIONS

Patent Examination Report No. 1 for corresponding AU Patent Application No. 2015203333; dated Feb. 6, 2016; pp. 1-2.

(Continued)

*Primary Examiner* — David J Bagnell
*Assistant Examiner* — Jonathan Malikasim
(74) *Attorney, Agent, or Firm* — Blank Rome LLP

(57) ABSTRACT

A downhole tool, such as a fracture plug used during a fracture operation, installs in a downhole tubular, such as casing. The tool has a mandrel with a sealing element disposed thereon between uphole and downhole ends. Slip assemblies on the mandrel can be moved to engage the downhole tubular. When the tool is used as a bridge plug, the uphole assembly supports the sealing element compressed, and the downhole assembly supports fluid pressure downhole of the tool. The slip assemblies have inserts composed of at least two materials that are different from one another and are geometrically separate from one another. In addition or as an alternative, the slip assemblies can be composed of at least two different materials that are geometrically separate from one another.

23 Claims, 9 Drawing Sheets

(56) References Cited

U.S. PATENT DOCUMENTS

| | | | | |
|---|---|---|---|---|
| 7,980,300 | B2 | 7/2011 | Roberts et al. | |
| 2008/0142275 | A1* | 6/2008 | Griffin | E21B 10/567 175/425 |
| 2012/0292053 | A1 | 11/2012 | Xu et al. | |
| 2013/0020071 | A1 | 1/2013 | O'Malley | |
| 2013/0048305 | A1 | 2/2013 | Xu et al. | |
| 2014/0090831 | A1 | 4/2014 | Young et al. | |

OTHER PUBLICATIONS

Extended European Search Report for corresponding EP Patent Application No. 15172687.4; dated Jan. 28, 2016; pp. 1-6.
Office Action from copending Canadian Application No. 2972906 dated Nov. 27, 2018, 3 pages.

* cited by examiner

INSERTS HAVING GEOMETRICALLY SEPARATE MATERIALS FOR SLIPS ON DOWNHOLE TOOL

CROSS-REFERENCE TO RELATED APPLICATIONS

This is non-provisional of U.S. Application Ser. No. 62/013,835 filed 18 Jun. 2014, which is incorporated herein by reference in its entirety and to which priority is claimed.

BACKGROUND OF THE DISCLOSURE

Slips are used for various downhole tools, such as bridge plugs and packers. The slips can have inserts or buttons to grip the inner wall of a casing or tubular. Inserts for slips are typically made from cast or forged metal, which is then machined and heat-treated to the proper engineering specifications according to conventional practices.

Inserts for slips on metallic and non-metallic tools (e.g., packers, plugs, etc.) must be able to engage with the casing to stop the tools from moving during its operation. On non-metallic tools, such as composite plugs, the inserts can cause the non-metallic slips to fail when increased loads are applied. Of course, when the slip fails, it disengages from the casing. On non-metallic tools, the inserts also need to be easily milled up to assist in the removal of the tools from the wellbore.

When conventional inserts are used in non-metallic slips, they are arranged and oriented as shown in FIG. 1A, for example. The slip 20 is disposed adjacent a mandrel 10 of a downhole tool, such as a bridge plug, a packer, or the like. As shown in FIG. 1B, the slip 20 moves away from the mandrel 10 and engages against a surrounding tubular or casing wall when the slip 20 and a cone 12 are moved toward one another. Either the slip 20 is pushed against the ramped surface of the cone 12, the cone 12 is pushed under the slip 20, or both.

FIG. 2A illustrates a side cross-section of a slip 20 having holes 23 according to the prior art for inserts (not shown), and FIG. 2B illustrates a side cross-section of the slip 20 with inserts 30 disposed in the holes 23. FIG. 2C illustrates a front view of the slip 20 with the holes 23 for the inserts (not shown). The slip 20 can have a semi-cylindrical shape. The holes 23 in the surface of the slip 20 can be an array of blind pockets. The inserts 30 are anchor studs that load into the holes 23 and can be held with a press fit or adhesive.

Examples of downhole tools with slips and inserts such as those above are disclosed in U.S. Pat. Nos. 5,984,007; 6,976,534; and 8,047,279. Other examples include Halliburton Obsidian® and Fas Drill® Fusion composite plugs and Boss Hog frac plugs. (OBSIDIAN and FAS DRILL are registered trademarks of Halliburton Energy Services, Inc.)

One particular type of downhole tool having slips is a composite fracture plug used in perforation and fracture operations. During the operations, the composite plugs need to be drilled up in as short of a period of time as possible and with no drill up issues. Conventional composite plugs use metallic wicker style slips, which are composed of cast iron. These metallic slips increase the metallic content of the plug and can cause issues during drill up in horizontal wells, especially when coil tubing is used during the milling operation.

Due to the drawbacks of cast iron slips, composite slips having inserts, such as described above, are preferably used to reduce the issues associated with metallic slips. Unfortunately, a large amount of metallic debris can still collect at the heel of the well and cause drill up problems when composite slips having inserts are used on tools. When composite slips are used, for example, the inserts are typically composed of carbide, which is a dense and heavy material. In other developments, it is known to use a composite slip having an insert composed of ceramic and an insert composed of a metallic ceramic composite, such as described in U.S. Pat. No. 6,976,534.

In any event, when the downhole tool having slips with carbide inserts are milled out of the casing, the inserts tend to collect in the casing and are hard to float back to the surface. In fact, in horizontal wells, the carbide inserts may tend to collect at the heel of the horizontal section and cause potential problems for operations. Given that a well may have upwards of forty or fifty bridge plugs used during operations that are later milled out, a considerable number of carbide inserts may be left in the casing and difficult to remove from downhole. Additionally, non-metallic buttons used to bite into the casing may tend to fracture due to loads applied onto them during the setting process. This leads to a loss in structural integrity and inability to retain the position of the bridge plug in the well consistently.

The subject matter of the present disclosure is directed to overcoming, or at least reducing the effects of, one or more of the problems set forth above.

SUMMARY OF THE DISCLOSURE

A downhole apparatus or tool, such as a composite bridge plug used during a fracture or perforation operations, installs in a downhole tubular, such as casing. The tool can have a mandrel with a sealing element disposed thereon. The sealing element can be compressible to engage the downhole tubular when the tool is activated by a wireline unit or the like.

A slip is disposed on the tool and is movable relative to the tool to engage the downhole tubular. The slip can have one or more slip bodies, segments, or elements disposed about the mandrel. For example, the segments can be arranged around the tool and can be individual or integrated segments, although other arrangements for the slip can be used. The slip can be composed of a non-metallic material, such as a plastic, a molded phenolic, a composite, a laminated non-metallic composite, an epoxy resin polymer with a glass fiber reinforcement, an ultra-high-molecular-weight polyethylene (UHMW), a polytetrafluroethylene (PTFE), etc.

One or more of the slips have one or more inserts composed of at least two materials, which may or may not be the same as one another. The materials are different from one another and are geometrically separate from one another. For example, one material may be a ceramic material, and the other material may be a metallic, a non-metallic, or a composite material. In another example, one material may be aluminum or other metal, and the other material may be tungsten carbide.

To achieve the geometric separation from one another, the at least two materials can be arranged in different geometric configurations on the insert, including layers, interposed central cores, outer disposed sheaths, distributed elements, and the like. Although the inserts have been primarily described herein as including two materials, it is envisioned that the inserts can be more than two materials in the geometric configurations disclosed herein.

The ceramic material for the inserts of the slip can be alumina, zirconia, or cermet. Use of the ceramic material can reduce the overall metallic content of the tool and can facilitate milling of the tool from the downhole tubular after use. The metallic material for the inserts can use a cast iron, a carbide, a cermet (i.e., composites composed of ceramic and metallic materials), a powdered metal, or a combination thereof. One or both of the materials of the insert can also be a dissolvable material intended to dissolve or degrade over a period of time in response to a trigger, conditions in the well, or the like.

The various arrangements noted herein can be interchanged and combined with one another in accordance with the teachings of the present disclosure. Additionally, the slip can be an individual body or segment, a unitary ring, one of a plurality of independent segments of a slip assembly, or one of a plurality of integrated segments of a slip assembly. In one implementation, the slip can comprise at least two materials that are different from one another and that are geometrically separate from one another.

Although suitable for a downhole tool, such as a fracture plug discussed above, the teaching of the present disclosure can apply to any of a number of downhole tools for engaging in a downhole tubular.

The foregoing summary is not intended to summarize each potential embodiment or every aspect of the present disclosure.

DETAILED DESCRIPTION OF THE DISCLOSURE

Figure 1A:
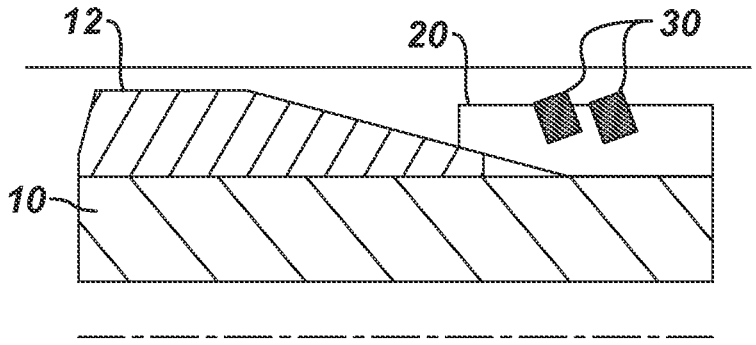
FIG. 1A (Prior Art)
FIG. 1A illustrates inserts used in a non-metallic slip according to the prior art.
Figure 1B:
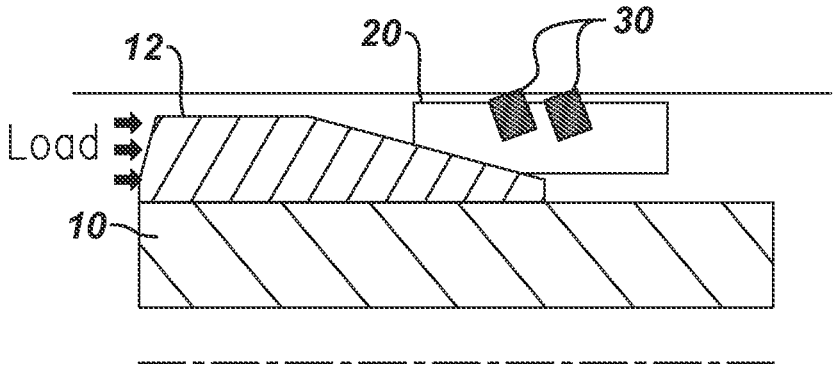
FIG. 1B (Prior Art)
FIG. 1B illustrates the slip of FIG. 1A during use.
Figure 2A:
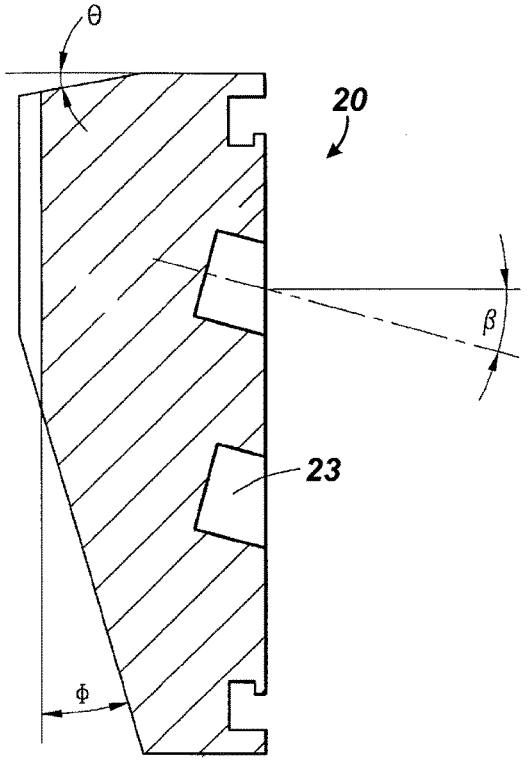
FIG. 2A (Prior Art)
FIG. 2A illustrates a side cross-section of a slip having holes for inserts according to the prior art.
Figure 2B:
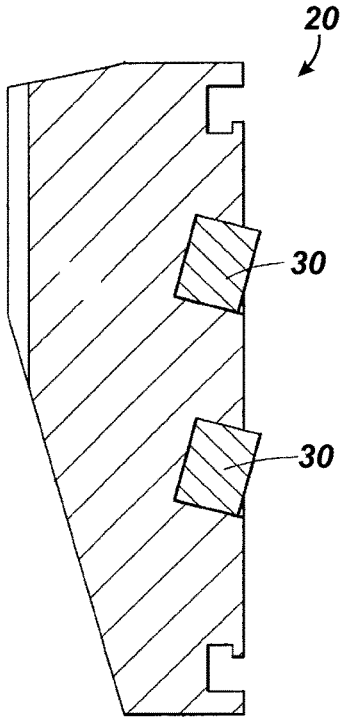
FIG. 2B (Prior Art)
FIG. 2B illustrates a side cross-section of the slip with inserts disposed in the holes.
Figure 2C:
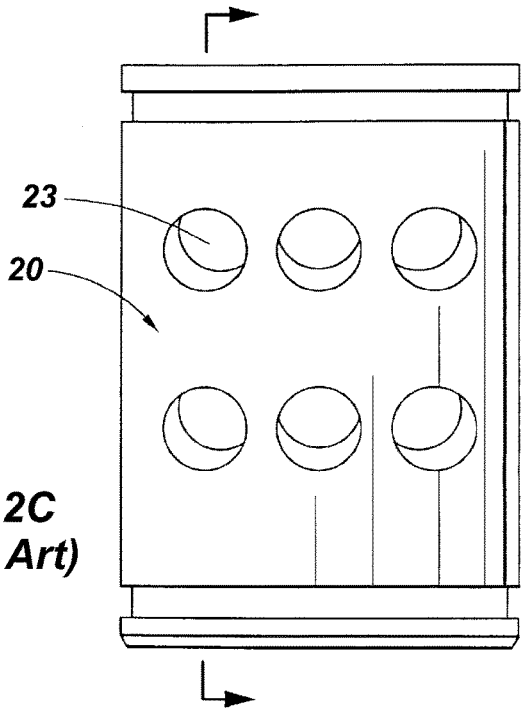
FIG. 2C (Prior Art)
FIG. 2C illustrates a front view of the slip with the holes for the inserts.
Figure 3:
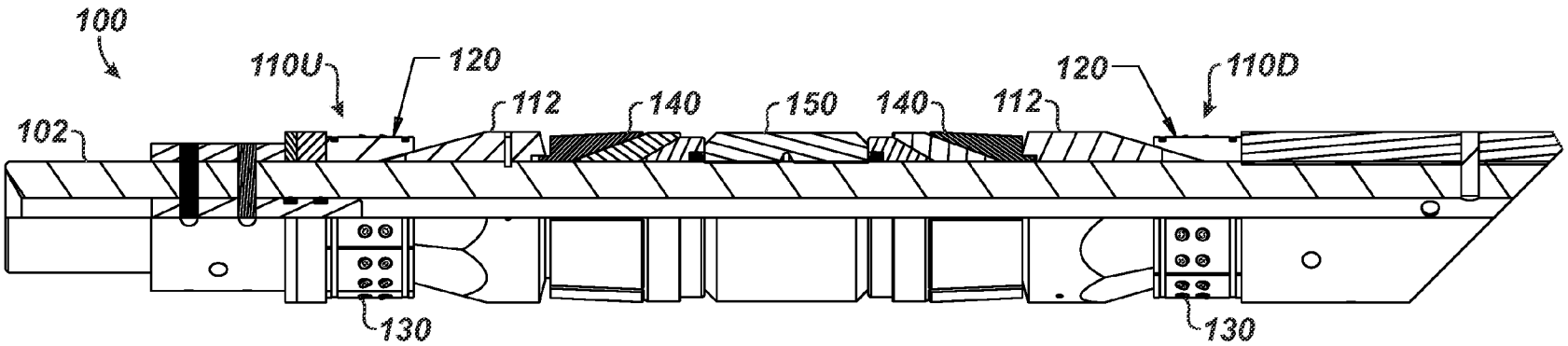
FIG. 3 illustrates a downhole tool in partial cross-section having slip assemblies according to the present disclosure.

FIG. 3 illustrates a downhole tool 100 in partial cross-section having slip assemblies 110U, 110D according to the present disclosure. The downhole tool 100 can be a bridge plug as shown, but it could also be a packer, a liner hanger, an anchoring device, or other downhole tool that uses a slip assembly to engage a downhole tubular, such as casing.

The tool 100 has a mandrel 102 having the slip assemblies 110U and 110D and backup rings 140 arranged on both sides of a packing element 150. Outside the inclined cones 112, the slip assemblies 110U and 110D have slips 120. Together, the slips 120 along with the cones 112 can be referred to as slip assemblies, or in other instances, just the slips 120 may be referred to as slip assemblies. In either case, either reference may be used interchangeably throughout the present disclosure. Thus, reference herein to a slip is not meant to refer only to one slip body, segment, or element, although it can. Instead, reference to slip can refer to more than just these connotations. As shown herein, slip assemblies 110U, 110D can have the same types of slips 120, but other arrangements could be used.

As a bridge plug, the tool 100 is preferably composed mostly of non-metallic components according to procedures and details as disclosed, for example, in U.S. Pat. No. 7,124,831, which is incorporated herein by reference in its entirety. This makes the tool 100 easy to mill out after use.

When deployed downhole, the tool 100 is activated by a wireline setting tool (not shown), which uses conventional techniques of pulling against the mandrel 102 while simultaneously pushing upper components against the slip assemblies 110U, 110D. As a result, the slips 120 of the slip assemblies 110U, 110D ride up the cones 112, the cones 112 move along the mandrel 102 toward one another, and the packing element 150 compresses and extends outward to engage a surrounding casing wall. The backup elements 140 control the extrusion of the packing element 150. In the process, the slips 120 on the assemblies 110U, 110D are pushed outward to engage the wall of the casing (not shown), which both maintains the tool 100 in place in the casing and keeps the packing element 150 contained.

The force used to set the tool 100 may be as high as 30,000 lbf and could be as high as 85,000 lbf. These values are only meant to be examples and could vary for the size of the tool 100. In any event, the set tool 100 isolates upper and lower portions of the casing so that fracture and other operations can be completed uphole of the tool 100, while pressure is kept from downhole locations. When used during fracture operations, for example, the tool 100 may isolate pressures of 10,000 psi or so.

As will be appreciated, any slipping or loosening of the tool 100 can compromise operations. Therefore, the slips 120 need to sufficiently grip the inside of the casing. Inserts 130 on the slips 120 engage in the casing.

At the same time, however, the tool 100 and most of its components are preferably composed of millable materials because the tool 100 is milled out of the casing once operations are done, as noted previously. As many as fifty such tools 100 can be used in one well and must be milled out at the end of operations. Therefore, having reliable tools 100 composed of entirely of millable material is of particular interest to operators. To that end, the slip assemblies 110U, 110D of the present disclosure are particularly suited for tools 100, such as bridge plugs, packers, and other downhole tools, and the challenges they offer.

Figure 4:
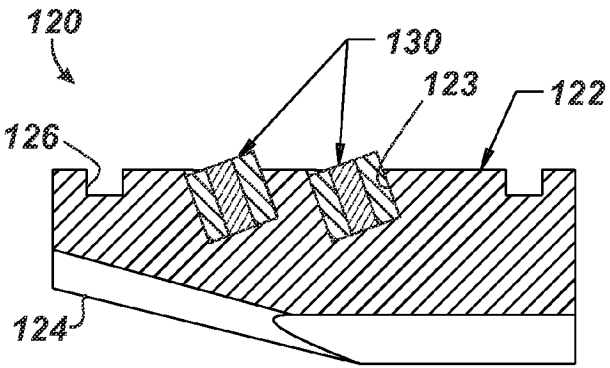
FIG. 4 illustrates a cross-sectional view of a slip having a first type of slip insert.

As shown in FIG. 4, one type of slip 120 for the assemblies 110 has a slip body or segment 122 with one or more individual inserts or buttons 130 disposed therein. The segment 122 can be one of several used on a slip assembly. For example, the segment 122 can be an independent slip component held around the tool's mandrel as in FIG. 3 with other slip segments and supported by bands.

In general, the segment 122 has an incline 124 for riding on a cone or other component of the downhole tool. Grooves 126 for bands may be provided in the outer surface depending on how the segment 122 is held to the downhole tool. In general, the segment 122 in FIG. 4 can have any number of inserts 130 arranged in one or more rows and/or one or more columns in the top surface. For instance, two rows of inserts 130 may be used, each having the same number of columns. Alternatively, two rows can be used, but one row may have two columns while the other has one column. These and other configurations can be used as will be appreciated.

In one arrangement, the inserts 130 can be the same size and can be disposed in equivalent sized holes 123 in the slip segment 122. In another arrangement, the depth of holes 123 can vary from segment to segment or from slip assembly to slip assembly. Therefore, one or more inserts 130 can be longer than the others. Additionally, the height of the inserts 130 can be the same on the given slip segment 122 once installed, but the depth of the holes 123 can vary. This can reduce the stress around the insert 130 in the base material. Other arrangements may have the inserts 130 at different heights and different depths relative to the slip segment 122.

Figure 5:
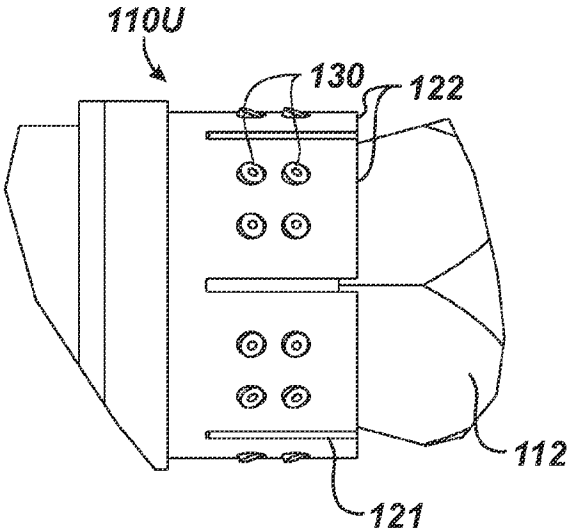
FIG. 5 illustrates a slip assembly having partially interconnected segments.

In both cases, the slip body 122 can comprise one of several independent segments of a slip assembly, such as on assemblies 110U, 110D shown in FIG. 3. As shown in FIG. 3, each body or segment 122 can have the same arrangement and number of inserts 130, although different arrangements can be used. Additionally, each segment 122 can be composed of the same or different materials from the other segments 122, and each insert 130 on a given segment 122 may be composed of the same or different materials from the other inserts 130. In other arrangements such as shown in FIG. 5, the slip body 122 can be a unitary ring or can be a partially integrated ring, as disclosed herein. Also as shown, the unitary ring of the slip body 122 may include features 121, such as splits, divisions, scores, slots or the like, to facilitate expansion of the slip body 122 when pushed against the cone 112.

In general, the slip body 122 is composed of a first material, and the one or more inserts 130 are composed of second materials exposed in the body's outer surface. The first material of the slip body 122 can generally be metal, composite, or the like. Preferably, the slip body 122 is composed of a millable material, such as a plastic, a non-metallic material, a molded phenolic, a laminated non-metallic composite, an epoxy resin polymer with a glass fiber reinforcement, an ultra-high-molecular-weight polyethylene (UHMW), a polytetrafluroethylene (PTFE), etc.

As disclosed in more detail below, the inserts 130 of the present disclosure have internal configurations of at least two materials that are geometrically separate from one another, having multiple layers, components, elements, or the like. The materials used for the inserts 130 can in general include metallic or non-metallic materials. For example, the inserts 130 can be composed of a carbide, a metallic material, a cast iron, a composite, a ceramic, a cermet (i.e., composites composed of ceramic and metallic materials), a powdered metal, or the like. Additionally, the inserts 130 preferably have a sufficient hardness, which may be a hardness equivalent to at least about 50-60 Rc. The powdered metal used can include a sinter-hardened powder metal steel material, although other types of powder metals, such as steel, iron, or high carbon steel materials can be used. The ceramic material of the insert 130 can be reinforced with metal or metal matrix composites (MMC).

Additionally, the materials used for the inserts 130 can be a dissolvable material that dissolves over a period of time in response to a trigger, a condition in the well, or the like. The dissolvable material can be used for all of the materials of the insert 130 or for one or more features of the insert's configurations (e.g., layers, components, elements, or the like), as disclosed below. Even if only a portion of the insert 130 is dissolvable, then the insert 130 will reduce to a smaller button size after use and there will be less material left in the well.

As an example of using a dissolvable material, the slip inserts 130 for the upper slip assembly 110U of FIG. 3 can use a dissolvable material because the upper slip 110U may be used primarily to hold back the packing element 150 during setting. Therefore, the upper slip inserts 130 can be made at least partially using a dissolvable material to reduce the amount of metallic content during mill-up after a fracture operation has been completed. Indeed, even the slips 120 of the upper assembly 110U can be made at least partially using a dissolvable material in the geometric configuration of the slips 120.

The shape of the inserts 130 can be the same or different from one another. In general, the inserts 130 can be cylindrical as shown in FIG. 4 or can have other shapes. For example, the insert 130 can have different geometries, such as those disclosed in U.S. application Ser. No. 14/039,032, filed 27 Sep. 2013, which is incorporated herein by reference in its entirety.

Figure 6A:
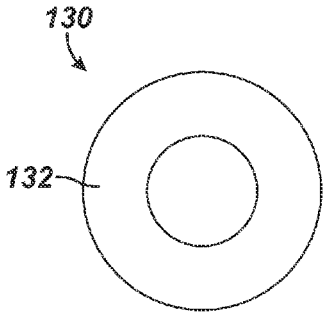
FIGS. 6A-6C illustrate top, cross-sectional, and perspective views of one configuration of a slip insert.
Figure 6B:
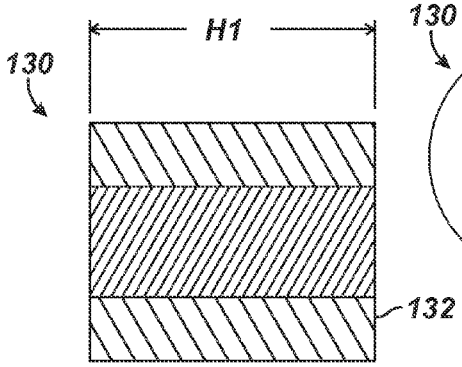
Figure 6C:
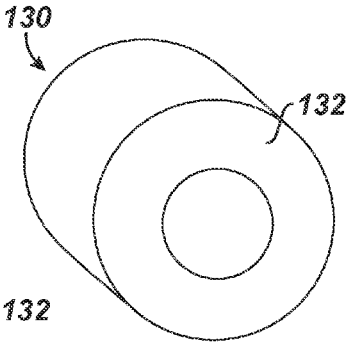

For instance, FIGS. 6A through 7C show examples of suitable geometries for the insert 130. FIGS. 6A-6C show top, cross-sectional, and perspective views of a cylindrical shape for an insert 130 of the present disclosure. The generally cylindrical insert 130 can have a diameter of about 0.3150-in., as shown on the top 132 of FIG. 5A. The overall height H1 can be about 0.375-in. These and other dimensions discussed herein are merely meant to provide example values.

Figure 7A:
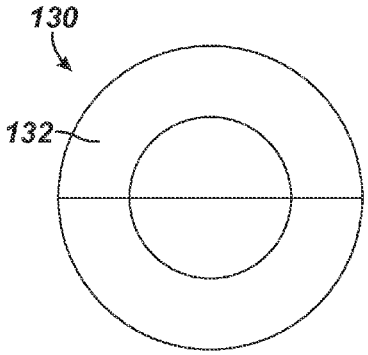
FIGS. 7A-7C illustrate top, cross-sectional, and perspective views of another configuration of a slip insert.
Figure 7B:
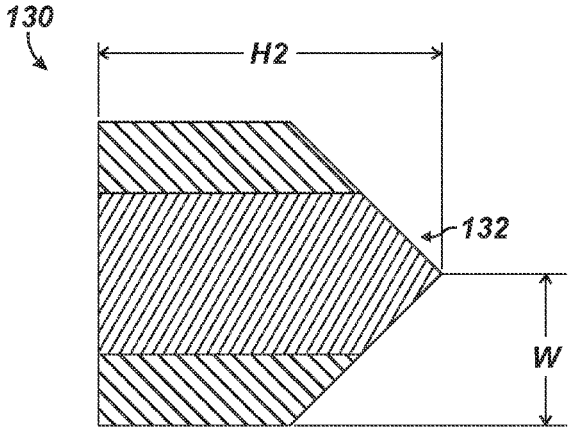
Figure 7C:
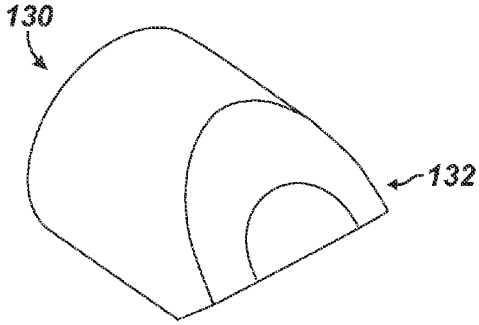

FIGS. 7A-7C show top, cross-sectional, and perspective views of another configuration for the insert 130 for the present disclosure. This insert 130 is also generally cylindrical with a diameter of 0.375-in., as shown in FIG. 7A. The insert 130 has an overall height H2 of about 0.423-in. The top end 132 of the insert 130, however, is cusped. Leading and tailing sides of the top end can be angled at 45-degrees. Other possible configurations for the insert 130 are disclosed in incorporated U.S. application Ser. No. 14/039,032. In fact, the inserts 130 can have other shapes rather than cylindrical buttons and can instead have the shape of an elongated strip, such as a wicker, or have other shapes as disclosed in incorporated U.S. application Ser. No. 14/039,032.

To get consistent results and not degrade the mechanical integrity, the inserts 130 of the present disclosure have internal configurations of the materials that are geometrically separate from one another, having multiple layers, components, elements, or the like. In particular, the inserts 130 depicted so far in FIGS. 3 through 7C have an inner core layer surrounded by an outer layer. FIGS. 8A through 11 illustrate perspective, cross-sectional views of internal configurations of slip inserts 130 according to the present disclosure.

Figure 8A:
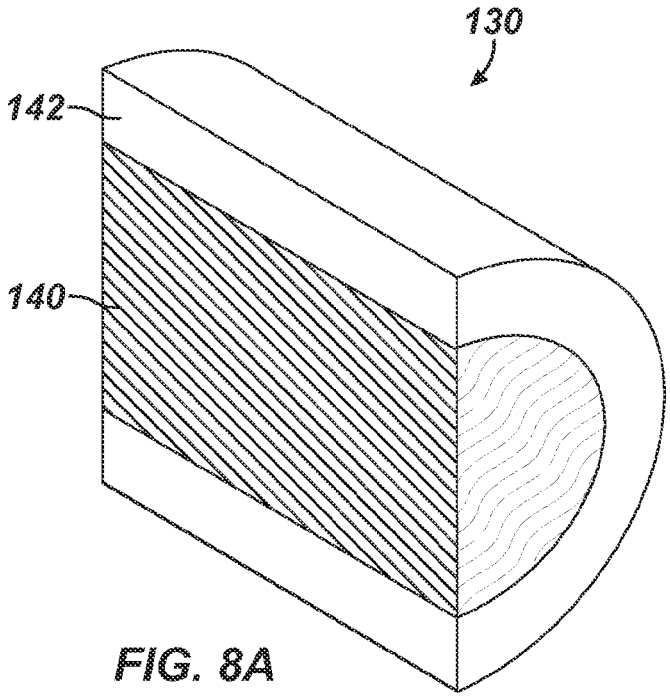
FIGS. 8A through 10B illustrate perspective, cross-sectional views of internal configurations of slip inserts according to the present disclosure.
Figure 8B:
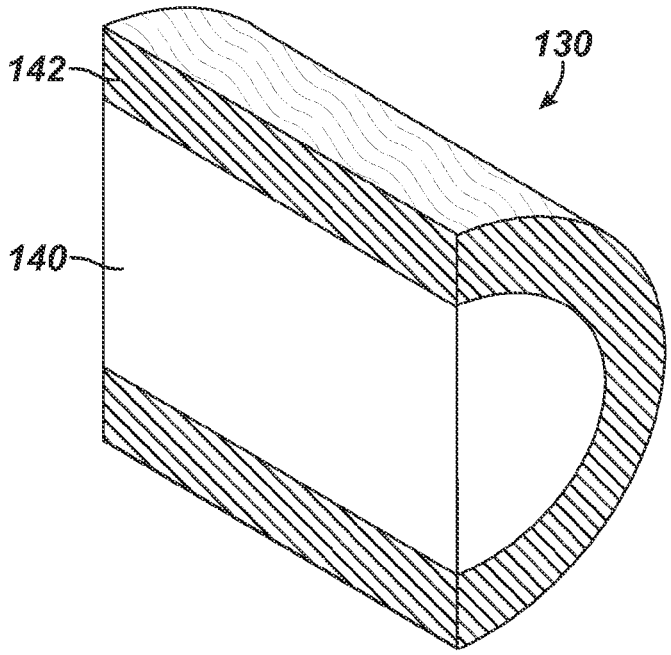

For example, the insert 130 may be composed primarily of a ceramic and can then have one or more metal, non-metal, or composite layers interposed therein and/or disposed thereabout. The layers can be used as a shield to protect the insert 130 during the setting process. For example, FIG. 8A shows the insert 130 having a core 140 composed of a first material surrounded by an outer shield 142 composed of a second material. In FIG. 8B, the same geometry is used, but the first and second materials are reversed. Although only two different materials are shown in these embodiment (as well as in any other embodiment disclosed herein), it will be appreciated with the benefit of the present disclosure that at least two materials can be used so that additional embodiments can include more than two materials in accordance with the present teachings.

In the arrangement of FIG. 8A, for example, the core 140 can be composed of a ceramic material disposed in the outer shield 142 composed of a metallic, a non-metallic, or a composite material. FIG. 8B is the reverse of this. In another option, the core 140 can be composed of a powdered metal, and the shield 142 can be composed of a different metal or a tungsten carbide. Alternatively, the core 140 can be tungsten carbide, and the shield 142 can be composed of a different material. These and other variations can be used.

Figure 9A:
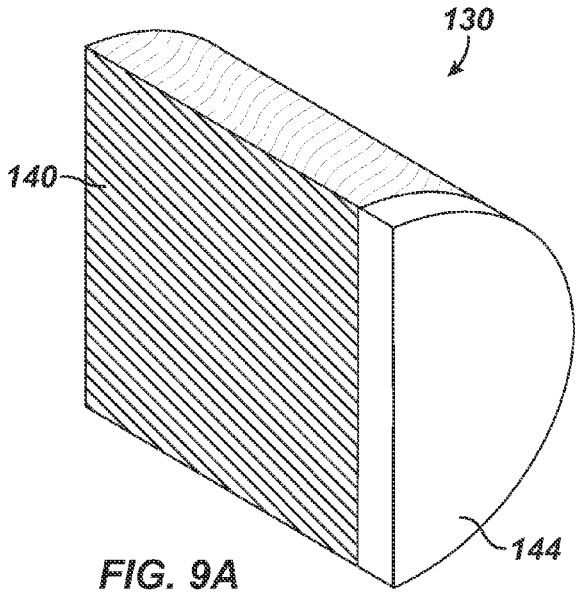

As shown in FIG. 9A, the insert 130 includes a core 140 composed of a first material having a top layer 144 of a second material disposed thereon. This top layer 144 can be a metal, a non-metal, or a composite material disposed on the core 140, and the top layer 144 can be used as a shield to protect the core 140 during the setting process. As one example, the core 140 can be composed of a ceramic, while the top layer 144 is composed of a tungsten carbide. As another example, the core 140 can be composed of a metal, while the top layer 144 is composed of a tungsten carbide. A reverse arrangement of the materials for the layer 144 and core 140 can also be used.

Figures 1, 9B:
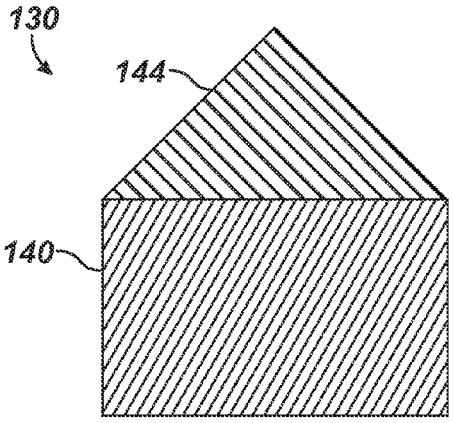
Figures 2, 9B:
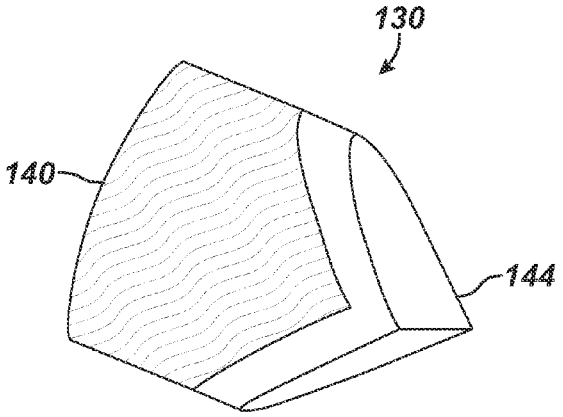
Figures 1, 9C:
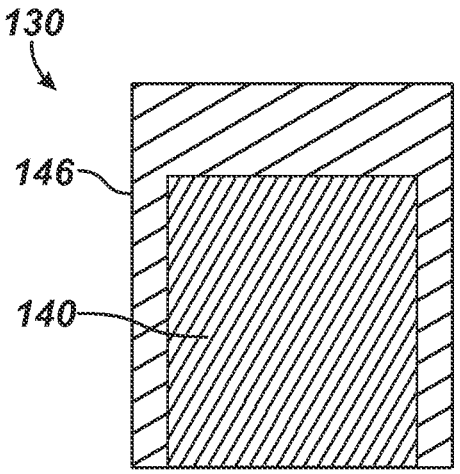
Figures 2, 9C:
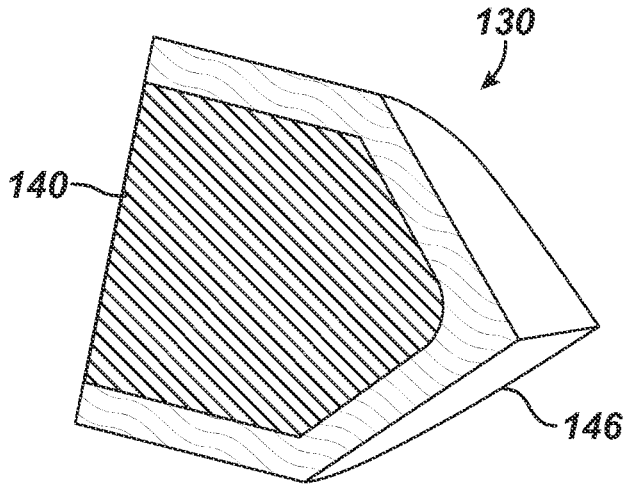

FIGS. 9B-1 and 9B-2 show a variation on this where the insert 130 again has a core 140 and a top layer or tip 144. The core 140 can be composed of a metal, such as a "lighter metal" like aluminum, while the cap 144 can be composed of tungsten carbide or the like. In FIGS. 9C-1 and 9C-2, yet another variation of the insert 130 has a core 140 and an outer cap 146. Again, the core 140 can be composed of a metal, and the outer cap 146 can be composed of tungsten carbide. With the benefit of the present disclosure, it will be appreciated that other variations of the materials can be used.

Figure 10A:
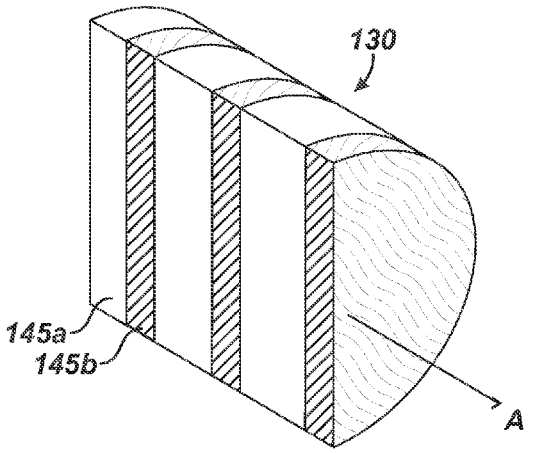
Figure 10B:
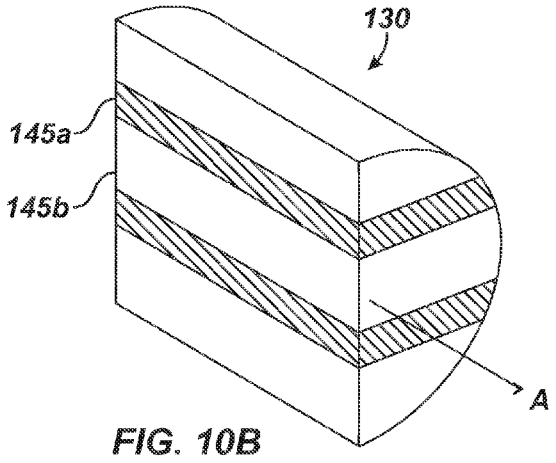

In yet another arrangement of FIG. 10A, the insert 130 has multiple alternating layers 145*a-b* of a ceramic material and a metal, a non-metal, or a composite material disposed orthogonally to the axis A of the insert 130. This arrangement can enhance the insert's hardness. Alternatively as shown in FIG. 10B, the insert 130 has multiple alternating layers 145*a-b* of a ceramic material and a metal, a non-metal, or a composite material disposed parallel to the axis A of the insert 130. In yet another alternative, the layers 145*a-b* can be arranged at other angles relative to the axis A of the insert 130.

Figure 11:
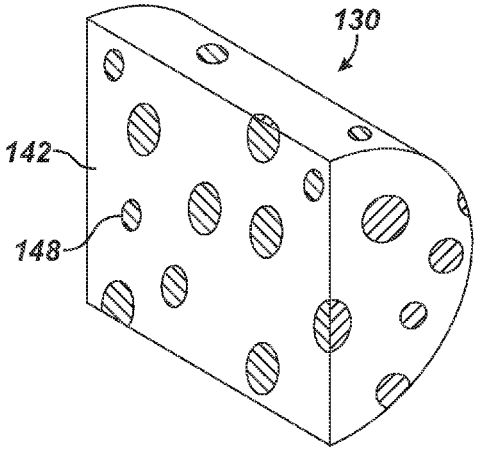
FIG. 11 illustrates a perspective, cross-sectional view of another internal configuration of a slip insert according to the present disclosure.

FIG. 11 illustrates a perspective, cross-sectional view of yet another internal configuration of a slip insert 130 according to the present disclosure. In this configuration, elements 148 (e.g., spheres, flakes, shards) of metal, non-metal, or composite material are distributed into a core 142 composed of another material (e.g., ceramic) during the manufacturing process to incorporate hardness and mitigate the propagation of fractures in the ceramic material during the setting and loading process. The elements 148 can be substantially consistent with one another in size and shape and may be distributed evenly, although variations may be used.

Although not explicitly depicted, it will be appreciated with the benefit of the present disclosure that inserts 130 according to the present disclosure can use various combinations of the arrangements disclosed above. As such, use of layers, interposed central members, outer disposed members, distributed elements, and the like disclosed above can be combined together with one another to form additional configurations suitable for the inserts 130 of the present disclosure. Moreover, any number of the inserts 130 used on a slip may have the same or different configuration.

Not only can the inserts 130 benefit from the arrangements disclosed herein. In fact, the slip 120 in which the inserts 130 are used can having comparable arrangements of layers, interposed central members, outer disposed members, distributed elements, and the like disclosed above. As examples, FIGS. 12A-12B illustrate cross-sectional views of a slip 120 according to the present disclosure having inserts 130.

In these embodiments, the body 122 of the slip 120 is composed of different materials. For example, the body 122 in FIG. 12A has a combination of first and second layers 126, 128 stacked on top of one another along the length of the body 122. One of these layers 126 can be composed of a ceramic material, while the other layers 128 can be composed of a second material (e.g., metal, non-metal, or composite). Other variations of material can be used.

Figure 12A:
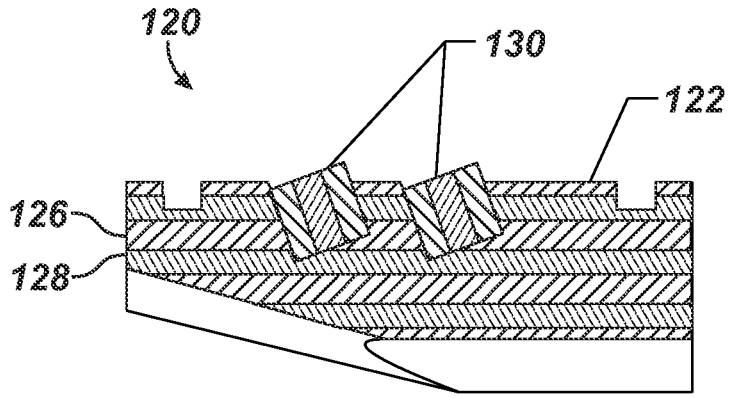
FIGS. 12A-12C illustrate cross-sectional views of a slip segment according to the present disclosure.

As shown in FIG. 12A, the slip body 122 can be composed primarily of the ceramic material of the first layers 126, and the second material (e.g., metal, non-metal, or composite) disposed in the second layers 128 can be dispersed in the slip body 122. The layers 126, 128 can run along the axis or plane of the slip body 122, although other arrangements can be used.

Figure 12B:
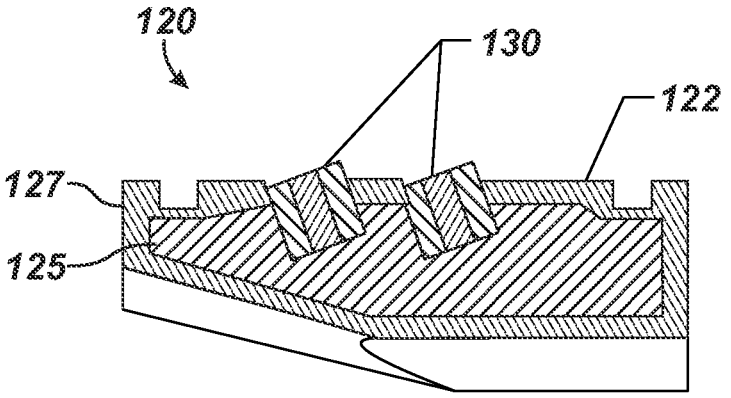

By contrast, the slip body 122 in FIG. 12B can be composed primarily of a core 125 of a first material, such as a ceramic material. An outer cover 127 of a second material (e.g., metal, non-metal, or composite) can be disposed in a layer (at least partially) around the core 125. Other variations of material can be used.

Figure 12C:
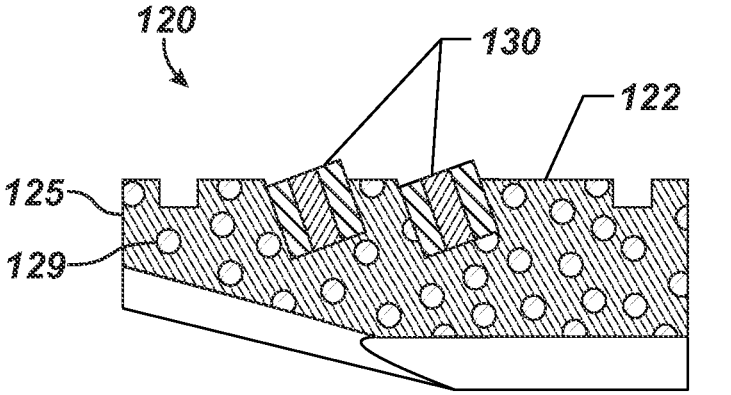

Further in line with the embodiments of the inserts, the slip body 122 as shown in FIG. 12C can have a comparable arrangement of first and second materials as the insert in FIG. 11. Namely, elements 129 (e.g., spheres, flakes, shards) of a first material are distributed into a core 125 composed of another material during the manufacturing process to incorporate hardness and mitigate the propagation of fractures in the core material during the setting and loading process. The elements 129 can be substantially consistent with one another in size and shape and may be distributed evenly, although variations may be used.

The slip 120 with these arrangements can carry higher loads than conventional composite slips, while the ceramic in the material will help break up the slip 120 during a mill-up, post fracing operation. The slips 120 can likewise have other configurations and orientations, such as those disclosed in incorporated U.S. application Ser. No. 14/039,032.

Manufacturing the inserts 130 and/or slips 120 with the at least two materials as disclosed here depends in part on the types of materials being used. It will be appreciated that suitable bonding between the materials is required in some of the arrangements, such as layers, caps, tips, etc. Overall, bonding one of the materials to another of the materials disclosed herein can use composite manufacturing techniques. For example, bonding between surfaces of the materials in the disclosed arrangements can involve one or more of preparing the surfaces, applying adhesive, curing the adhesive, and applying pressure. Molding of the materials in the geometric arrangements can also be used depending on the materials involved, such as for embedded elements in a core material. Brazing, welding, and the like can also be used between the materials of the arrangements, such as between layers, core and surrounding shield, etc. Manufacturing the inserts 130 and/or slips 120 with the at least two materials can also involve press fitting the materials of the arrangements together.

Embodiments of the present disclosure can be characterized as follows. A downhole apparatus for engaging in a downhole tubular comprises at least one slip disposed on the apparatus and being movable relative to the apparatus toward the downhole tubular. At least one insert is disposed on the at least one slip and is adapted to engage the downhole tubular. The at least one insert is at least composed of first and second materials being different from one another and being geometrically separate from one another.

The at least one slip can comprise a slip body composed of a non-metallic material, and the non-metallic material comprises a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof. The at least one slip can comprise a plurality of segments disposed about the apparatus, such as about a mandrel of the apparatus.

The first material can comprise a ceramic material, which can be alumina, zirconia, or cermet. The second material can comprise a metallic, a non-metallic, or a composite material, which can be a cast iron, a carbide, a metallic-ceramic composite material, a cermet, a powdered metal, or a combination thereof.

The apparatus can have a mandrel having the at least one slip disposed thereon and can have a sealing element disposed on the mandrel and being compressible to engage the downhole tubular.

In one embodiment, the first material of the at least one insert comprises a core, and the second material of the at least one insert comprises a sheath disposed about an outside of the core. In another embodiment, the first material of the at least one insert comprises a core, and the second material of the at least one insert comprises a layer disposed on an end of the core. In yet another embodiment, the first material of the at least one insert comprises first layers, and the second material of the at least one insert comprises second layers interposed between the first layers. The first and second layers can be arranged at an angle relative to an axis of the at least one insert. For example, the angle can be either orthogonal or parallel to the axis of the at least one insert. In still another embodiment, the first material of the at least one insert comprises a core, and the second material of the at least one insert comprises elements distributed in the core.

Additional embodiments of the present disclosure can be characterized as follows. A downhole apparatus for engaging in a downhole tubular comprises at least one slip disposed on the apparatus and being movable relative to the apparatus toward the downhole tubular. The at least one slip is at least composed of first and second materials being different from one another and being geometrically separate from one another. At least one insert is disposed on the at least one slip and is adapted to engage the downhole tubular. This at least one insert can also be composed of third and fourth materials being different from one another.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for plugging a downhole tubular of a well, the apparatus comprising:

a tool deploying in the downhole tubular, the tool plugging the downhole tubular for use and being removed in place from the downhole tubular after use;

at least one slip disposed on the tool and being movable relative to the tool; and at least one insert disposed on the at least one slip and adapted to engage the downhole tubular, the at least one insert having an initial size and being at least composed of first and second materials, the first and second materials being different from one another and being disposed in a plurality of planar layers geometrically separate from one another, first of the planar layers of the first material being configured to remove after use, second of the planar layers of the second material being configured to at least remain after use as smaller than the initial size of the at least one insert.

2. The apparatus of claim 1, wherein the at least one slip comprises a slip body composed of a non-metallic material.

3. The apparatus of claim 2, wherein the non-metallic material comprises a plastic, a molded phenolic, a laminated non-metallic composite, an epoxy resin polymer with a glass fiber reinforcement, an ultra-high-molecular-weight polyethylene (UHMW), a polytetrafluroethylene (PTFE), or a combination thereof.

4. The apparatus of claim 1, wherein the at least one slip comprises a plurality of segments disposed about the apparatus.

5. The apparatus of claim 1, wherein the first material of the first of the planar layers comprises a ceramic material.

6. The apparatus of claim 5, wherein the ceramic material comprises alumina, zirconia, or cermet.

7. The apparatus of claim 1, wherein the second material of the second of the planar layers comprises a metallic, a non-metallic, or a composite material.

8. The apparatus of claim 1, wherein the second material of the second of the planar layers comprises a cast iron, a carbide, a metallic-ceramic composite material, a cermet, a powdered metal, or a combination thereof.

9. The apparatus of claim 1, wherein the first material of the first of the planar layers comprises a dissolvable material.

10. The apparatus of claim 1, wherein the tool comprises:

a mandrel having the at least one slip disposed thereon; and a cone disposed on the mandrel adjacent the at least one slip, the cone and the at least one slip being movable relative to one another and moving the at least one slip toward the downhole tubular.

11. The apparatus of claim 10, wherein the tool comprises a sealing element disposed on the mandrel and being compressible to engage the downhole tubular.

12. The apparatus of claim 1, the second of the planar layers are interposed between the first planar layers of the at least one insert.

13. The apparatus of claim 1, wherein the first and second planar layers are arranged at an angle relative to an axis of the at least one insert.

14. The apparatus of claim 13, wherein the angle is orthogonal or parallel to the axis of the at least one insert.

15. The apparatus of claim 1, wherein the at least one slip is at least composed of third and fourth materials, the third and fourth materials being different from one another and being geometrically separate from one another.

16. The apparatus of claim 15, wherein the third material comprises a core of the at least one slip having an outside surface; wherein the fourth material of the at least one slip comprises a sheath disposed about at least a portion of the outside of the core.

17. The apparatus of claim 15, wherein the third material comprises a plurality of third planar layers of the at least one slip; and wherein the fourth material of the at least one slip comprises a plurality of fourth planar layers interposed between the third planar layers of the at least one slip.

18. The apparatus of claim 17, wherein the third and fourth planar layers are arranged at an angle relative to an axis of the at least one slip.

19. A downhole apparatus for plugging a downhole tubular of a well, the apparatus comprising:

a tool deploying in the downhole tubular, the tool plugging the downhole tubular for use and being removed in place from the downhole tubular after use;

at least one slip disposed on the tool and being movable relative to the tool; and at least one insert disposed on the at least one slip and adapted to engage the downhole tubular, the at least one insert having an initial size and being at least composed of a dissolvable material and a second material, the dissolvable material and the second material being different from one another and being disposed in a plurality of planar layers geometrically separate from one another, first of the planar layers of the dissolvable material being configured to dissolve after use, second of the planar layers of the second material being configured to at least remain after use as smaller than the initial size of the at least one insert.

20. The apparatus of claim 19, wherein the second material comprises a metallic material, a non-metallic material, a composite material, a cast iron, a carbide, a metallic-ceramic composite material, a cermet, a powdered metal, or a combination thereof configured to at least remain after use even with milling of the tool from the downhole tubular.

21. A downhole apparatus for plugging a downhole tubular of a well, the apparatus comprising:

a tool deploying in the downhole tubular, the tool plugging the downhole tubular for use and being removed in place from the downhole tubular after use;

at least one slip disposed on the tool and being movable relative to the tool; and at least one insert disposed on the at least one slip and adapted to engage the downhole tubular, the at least one insert having an initial size and being at least composed of first and second materials, the first and second materials being different from one another and being disposed as geometrically separate elements from one another, first of the geometrically separate elements of the first material being configured to remove after use, second of the geometrically separate elements of the second material being configured to at least remain after use as smaller than the initial size of the at least one insert.

22. The apparatus of claim 21, wherein the first material comprises a millable material or a dissolvable material.

23. The apparatus of claim 21, wherein the second material comprises a metallic material, a non-metallic material, a composite material, a cast iron, a carbide, a metallic-ceramic composite material, a cermet, a powdered metal, or a combination thereof.

* * * * *